US007094081B1

(12) United States Patent
Senk et al.

(10) Patent No.: US 7,094,081 B1
(45) Date of Patent: Aug. 22, 2006

(54) ELECTRICAL CONNECTOR ASSEMBLY

(75) Inventors: Joseph M. Senk, Cortland, OH (US); Patrick J. Reedy, Youngstown, OH (US); Raymond J. Blasko, Boardman, OH (US); Barry M. Daggett, Austintown, OH (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 11/088,420

(22) Filed: Mar. 24, 2005

(51) Int. Cl.
*H01R 13/62* (2006.01)

(52) U.S. Cl. ..... 439/157

(58) Field of Classification Search ..... 439/157, 439/160, 310, 342, 372; 361/752, 776, 791
See application file for complete search history.

(56) References Cited

U.S. PATENT DOCUMENTS 4,786,256 A * 11/1988 Angeleri et al. ..... 439/72
5,493,237 A * 2/1996 Volz et al. ..... 324/754
5,715,135 A 2/1998 Brussalis et al.
5,788,529 A 8/1998 Borzi et al.
6,254,414 B1 * 7/2001 Sawayanagi et al. ..... 439/310
6,500,015 B1 * 12/2002 Fukamachi et al. ..... 439/157
6,626,682 B1 * 9/2003 Sausen ..... 439/70
6,739,889 B1 * 5/2004 Daggett et al. ..... 439/157
6,887,089 B1 * 5/2005 Nishide ..... 439/157

* cited by examiner

*Primary Examiner*—Alexander Gilman
(74) *Attorney, Agent, or Firm*—David P. Wood

(57) ABSTRACT

The present invention provides an electrical connector assembly and a method of mating the same. The electrical connector assembly includes a panel sub-assembly which mates to at least one electrical connector body. Preferably two cam leveraging devices which rotate in opposing directions are mounted rotatably to the panel sub-assembly for sliding engagement of respective cam studs engaged rigidly to the electrical connector body. Opposing rotations of the cam leveraging devices along respective and parallel rotation axes causes the panel sub-assembly to move linearly along a mating axis disposed orthogonally to the rotation axes and toward the electrical connector body to a staged position. During linear panel sub-assembly movement from the disconnected position to the staged position, the cam studs slide against a first portion of a track carried by respective cam levers and which generally spirals radially inward toward the rotation axis. Reversing rotation of both cam leveraging devices causes the panel sub-assembly to continue linear movement toward the electrical connector body from the staged position and to a mated position. During linear panel sub-assembly movement from the staged position to the mated position, the cam stud lifts off of the first portion, and is caught by and slides along a second portion of the track to a mated end.

24 Claims, 9 Drawing Sheets

ELECTRICAL CONNECTOR ASSEMBLY

FIELD OF THE INVENTION

The present invention relates generally to electrical connector assemblies, and more to methods for mating electrical connector assemblies.

BACKGROUND OF THE INVENTION

Electrical connector assemblies, such as a simple electrical connector or a multi-functional electrical distribution center, are widely used. The electrical distribution centers are generally a central junction box or block system designed as a stand-alone assembly. The electrical connectors typically electrically connect at least two wire harnesses together and thus house a plurality of mated male and female terminals. The distribution centers perform a similar function as the electrical connectors, but may also house various fuses, relays and other electrical devices in a central location. Electrical distribution centers not only reduce cost by consolidating various functions and/or electrical connections into one block, but the centers also reduce the number of cut and spliced leads which increases reliability. Such electrical distribution centers include provisions for electrically connecting a power source and electrical devices housed in the junction block to electrical wiring harness connectors for supplying power and control signals to various electrical systems.

In many electrical distribution center applications, such as that used in the engine compartment of a vehicle, disclosed in U.S. Pat. No. 5,715,135, to Brussalis, incorporated by reference, devices such as fuses and relays of the electrical distribution centers are accessible from the top with mating connectors protruding from a bottom side. Unfortunately, due to this orientation, access to the connectors is often difficult for mating and unmating. In many cases, the electrical distribution center has to be flipped upside down, the connectors assembled, and the entire assembly with protruding wire harnesses flipped again into a final position.

Known electrical distribution centers such as that in the '135 Brussalis reference, typically mount the fuses, relays and electrical devices to a top side of an upper electrical distribution panel. A plurality of double ended terminals are engaged to and extend through a tray located below the panel. A top end of each terminal projects through a respective slot of the upper panel for engagement to the fuse, relay or electrical device. A bottom end of the male terminal projects downward through respective slots of yet a second lower tray for electrical engagement to terminals locked into at least one electrical connector body which is engaged to a lower support structure of the distribution center. Unfortunately, the panel, trays and connector bodies are all held together by a plurality of threaded fasteners which is costly to manufacture and requires special tools for assembly and maintenance purposes.

Known improvements to this conventional distribution assembly are described in U.S. Pat. No. 5,788,529 to Borzi issued Aug. 4, 1988 and U.S. Pat. No. 6,739,889 B1, to Daggett, issued May 25, 2004, and incorporated herein by reference. In '529 Borzi and '889 Daggett, the distribution assembly is not flipped when assembling internal connectors and does not require the use of threaded fasteners or bolts thus does not need special assembly tools to secure various housings of the distribution assembly together. Instead, an engagement mechanism or leverage device having four independent cam levers applies a normal force when the cam levers are rotated to mate the distribution assembly. Simultaneous rotation of the four levers also produces a moment which is countered by various structural and alignment features incorporated into this known distribution assembly to maintain alignment of the terminals during mating.

SUMMARY OF THE INVENTION

The present invention provides an electrical connector assembly and a method of mating the same. The electrical connector assembly includes a panel sub-assembly which mates to at least one electrical connector body. Preferably two cam leveraging devices which rotate in opposing directions are mounted rotatably to the panel sub-assembly for sliding engagement of respective cam studs engaged rigidly to the electrical connector body. Opposing rotations of the cam leveraging devices along respective and parallel rotation axes causes the panel sub-assembly to move linearly along a mating axis disposed orthogonally to the rotation axes and toward the electrical connector body to a staged position. During linear panel sub-assembly movement from the disconnected position to the staged position, the cam studs slide against a first portion of a track carried by respective cam levers and which generally spirals radially inward toward the rotation axis. Reversing rotation of both cam leveraging devices causes the panel sub-assembly to continue linear movement toward the electrical connector body from the staged position and to a mated position. During linear panel sub-assembly movement from the staged position to the mated position, the cam stud lifts off of the first portion, and is caught by and slides along a second portion of the track to a mated end.

Objects, features and advantages of this invention include a cam levered electrical connector assembly which is easily aligned for mating, is capable of smooth and relatively easy mating and unmating of an electrical connection, utilizes cam levers which require minimal rotation in any one direction yet produce an appreciable amount of linear movement along a mating axis and without producing any moments or normal forces with respect to the mating axis. Further advantages include a relatively simple, robust and inexpensive design being maintenance free and having a long and useful life.

BRIEF DESCRIPTION OF THE DRAWINGS

These and other objects, features and advantages of this invention will be apparent from the following detailed description of the preferred embodiments and best mode, appended claims and accompanying drawings in which:

DETAILED DESCRIPTION OF A PREFERRED EMBODIMENT

Figure 1:
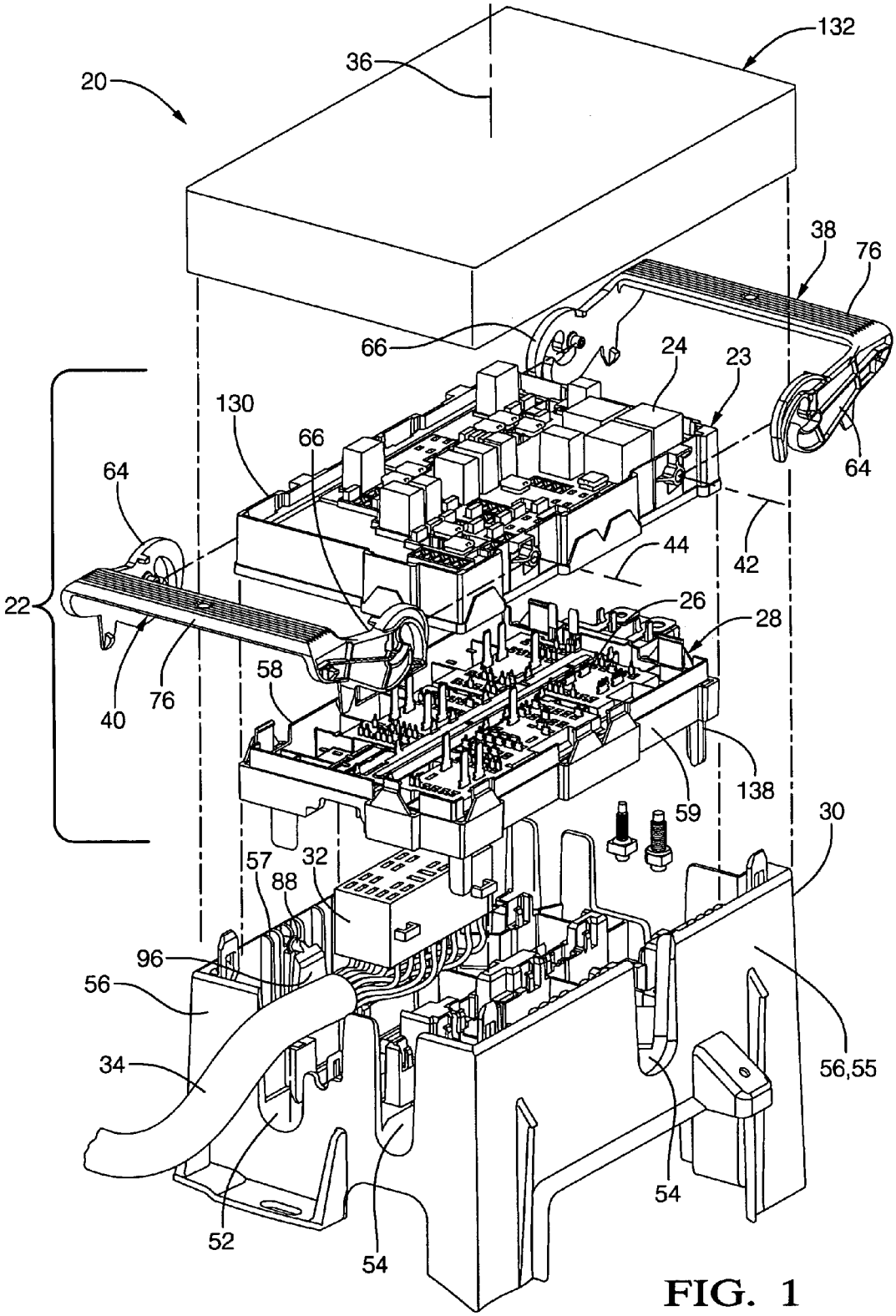
FIG. 1 is an exploded perspective view of an electrical connector assembly of the present invention.
Figure 2:
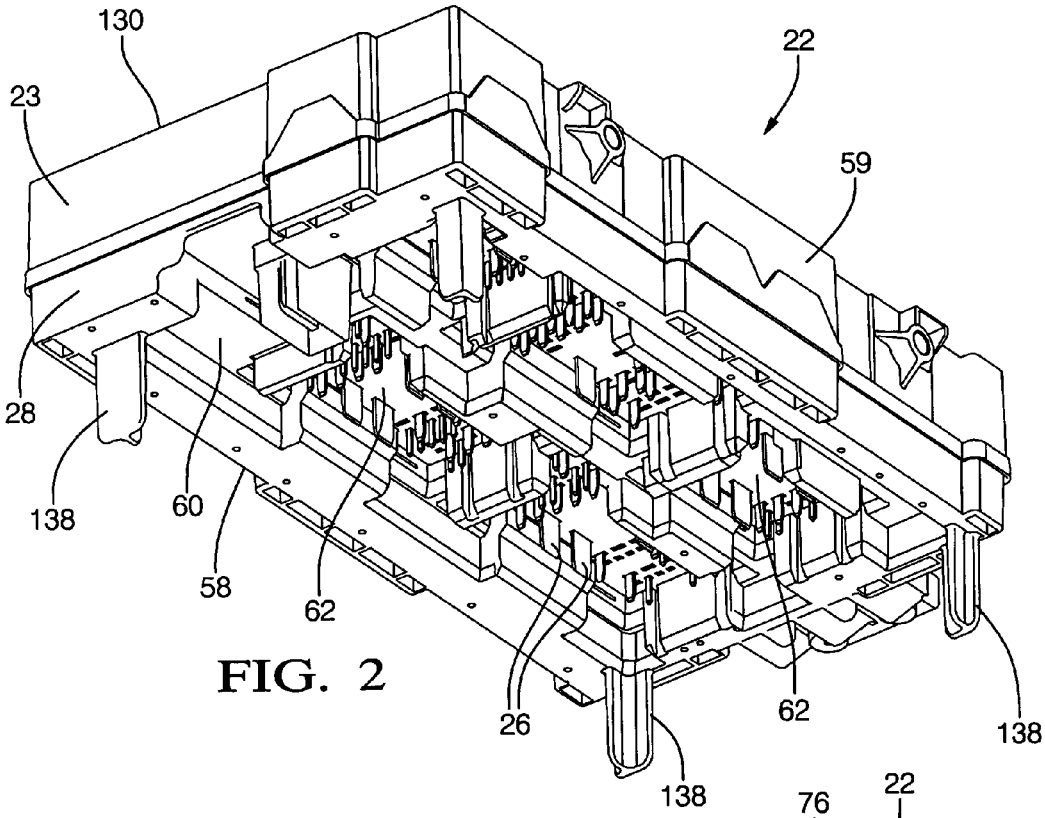
FIG. 2 is a perspective bottom view of an electrical distribution panel of the electrical connector assembly.
Figure 3:
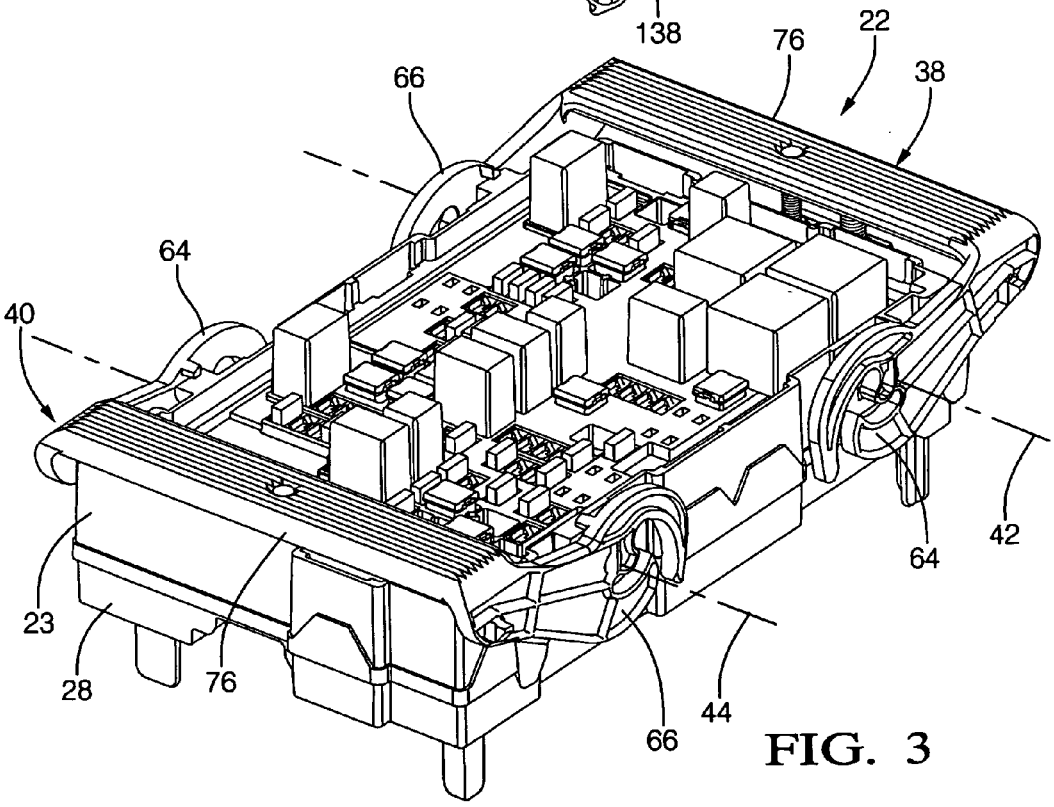
FIG. 3 is a perspective top view of the electrical distribution panel.

Referring to the figures wherein like numerals refer to like elements throughout the several views, FIG. 1 illustrates a preferred embodiment of an electrical connector assembly 20 of the present invention. The electrical connector assembly 20 is preferably an electrical distribution center, but can also be any device which makes an electrical connection including an electrical connector. The electrical connector assembly 20 is shown as an electrical distribution center preferably having an electrical panel sub-assembly 22 having a panel 23 supporting electrical relays, fuses, control modules, and/or terminals 24 which are preferably mated to a series of substantially vertical male terminals 26 supported by a mid tray 28 of the sub-assembly 22 located beneath and pre-engaged to the panel 23. If the electrical connector assembly 20 is a simpler electrical connector, the panel 23 and tray 28 are preferably injection molded as one unitary plastic piece which supports terminals 24 but preferably not relays, fuses and control modules. An electrical connector support structure 30 supports at least one electrical connector body 32 (spaces for five shown) having a series of electrical terminals (not shown) attached electrically at one end to respective wires of a wire harness 34 and engaged electrically at an opposite upward end to the respective terminals 26 when the assembly 20 is mated.

The panel sub-assembly 22 mates to the support structure 30 and thus the supported electrical connector bodies 32 along a linear, central, mating axis 36 by an assembler's, simultaneous, actuation of opposing leveraging devices 38, 40 which are mounted rotatably to the panel 23. Each leveraging device 38, 40 rotates about a respective rotation axis 42, 44 which are disposed substantially orthogonally or perpendicular to the mating axis 36. Preferably, the rotation axes 42, 44 are substantially parallel to one another and lie within a common imaginary plane also disposed substantially orthogonally to the mating axis 36. The two leveraging devices 38, 40 are preferably spaced substantially equally from the center mating axis 36 and operate in reverse rotational directions from one-another in order to cancel out one-another's rotational moments and producing a net force substantially dedicated in the mating axis 36 direction. This alleviates any lateral movement of the panel sub-assembly 22 with respect to the central mating axis 36 and any rotational movement of the panel 23 and tray 24 in the imaginary plane. With all motion thus concentrated along the mating axis 36, friction generally between the panel 23 and support structure 30 during the mating process is substantially reduced along with any possibility of misalignment of the terminals 26 with the connector bodies 32.

Figures 8, 8A:
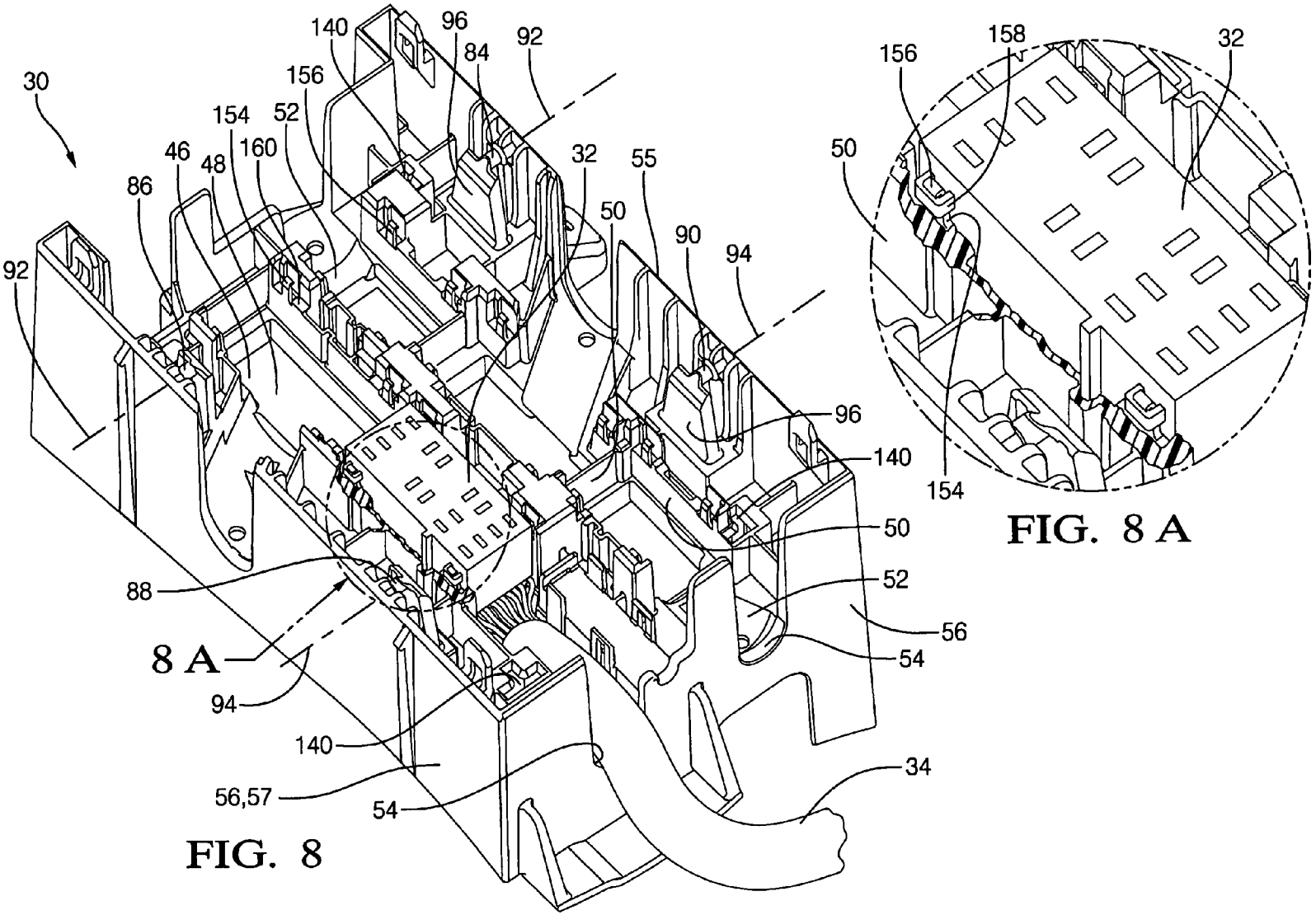
FIG. 8 is a perspective top view of at least one electrical connector body engaged to a support structure of the electrical connector assembly.
FIG. 8*a* is a partial enlarged view of the support structure taken from the circle 8*a* of FIG. 8.
Figure 9:
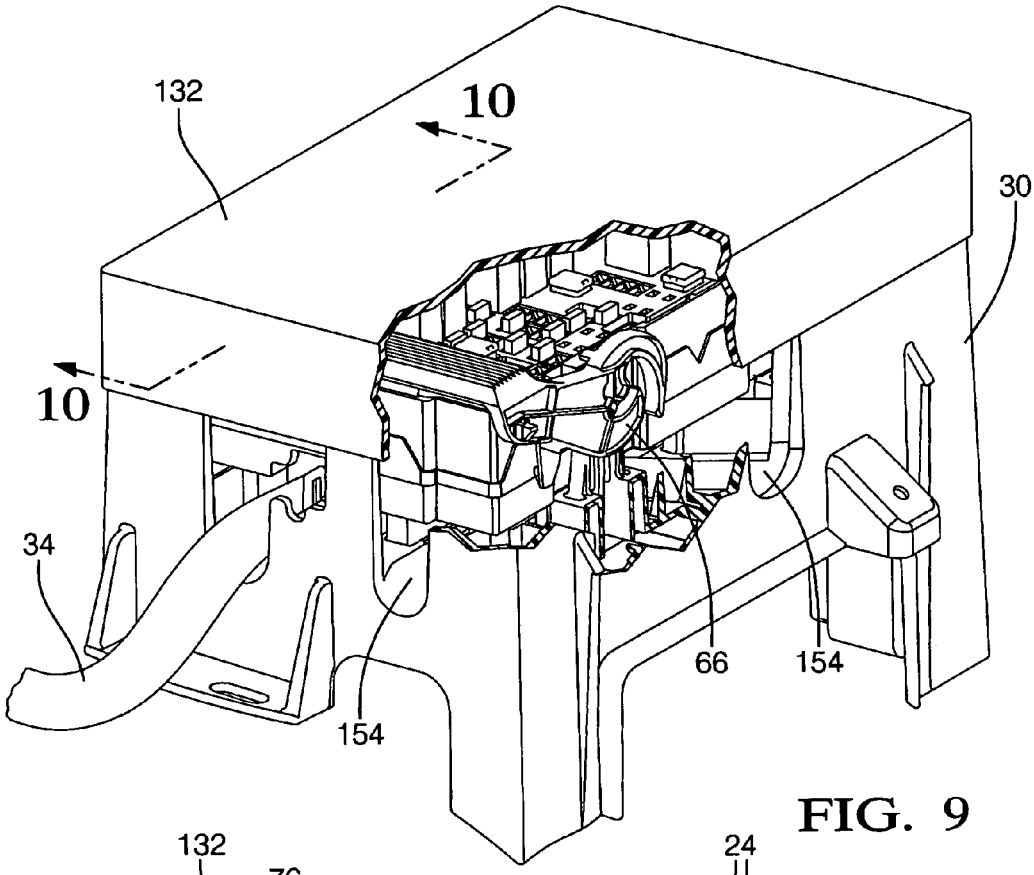
FIG. 9 is a cross section of the electrical connector body engaged to the support structure and taken along line 9—9 of FIG. 8.
Figure 10:
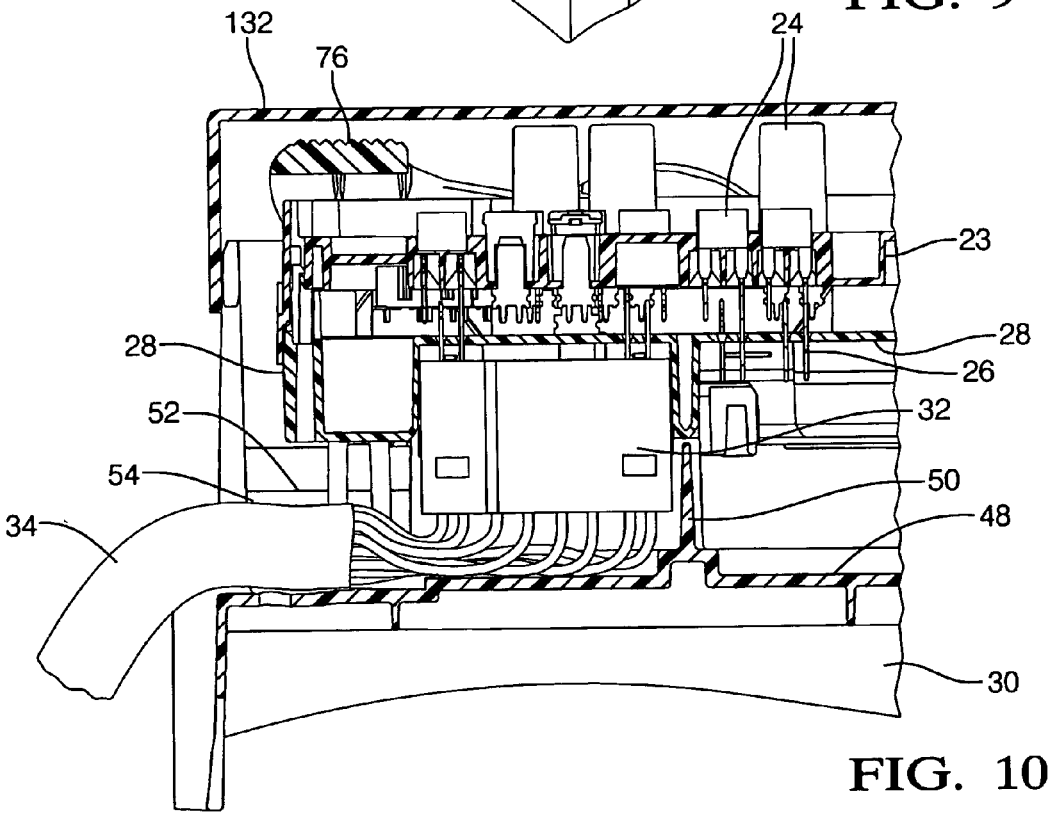
FIG. 10 is a partial cross section view of the electrical connector assembly taken along line 10—10 of FIG. 9.

Referring to FIGS. 1, 8, and 10 during assembly, the female terminals (not shown) are preferably crimped to respective leads of the wire harness 34. The terminals are then inserted upward through a bottom side of the electrical connector body 32. The bodies 32 are placed in-part into respective cavities 46 defined by a contoured bottom 48 and peripheral walls or wire dressing cover 50 projecting unitarily upward from the bottom 48. A snap fit engagement to the peripheral walls 46 holds the connector bodies in an elevated state with respect to the contoured bottom 48 of the support structure 30 to permit routing of the respective wire harness 34. From the bottom side of the electrical connector body 32, the wire harness 34 routes through the peripheral wall 50 and preferably into a respective harness channel 52 generally defined by the contoured bottom 48, and through an access hole or large notch 54 opening upward and disposed in any one of four exterior side walls 56 of the support structure 30 and open upward.

When the assembly 20 is mated, opposite upward projecting exterior side walls 55, 57 of the four side walls 56 generally envelop respective sides 58, 59 of the panel sub-assembly 22 and mid tray 28 to protect the internal electrical components 24 and leveraging devices 38, 40 from debris, excessive moisture, and external forces. Also when mated, the male blades 26 which project downward from a contoured bottom face 60 of the mid tray 28 are electrically mated to the female terminals of the electrical connector bodies 32. The contoured bottom face 60 of the mid tray 28 defines a series of voids 62 which receive an upward projecting portion of the respective electrical connector bodies 32 for improved alignment during the mating process and structural integrity of the assembly 20. Upon un-mating of the assembly 20 along the mating axis 36, the panel 23 and tray 28 together lift away from the support structure 30 while a lock fit of the electrical connector bodies 32 to the support structure 30 prevents the bodies from remaining in the voids 62 of the mid tray 28 and holds the bodies 32 in the cavities 46 of the support structure 30.

Referring to FIGS. 1 and 4–7, in further regards to the generally diametrically opposed cam leverage devices 38, 40, each device has a pair of cam levers 64, 66 each having a radially outward projecting arm or elongated first section 68, 70 connected together at distal ends 72, 74 by an elongated handle 76 disposed substantially parallel to the rotation axes 42, 44. Respective second sections 78, 80 of each cam lever 64, 66 are substanitally diametrically opposed to the elongated first sections 68, 70 and each carry a track 82 for sliding contact with respective cam projections or substantially cylindrical studs 84, 86, 88, 90 engaged rigidly to the support structure 30. The track 80 of each lever 64, 66 generally spirals radially inward toward the common rotation axis 42 for the leveraging device 38 and the common rotation axis 44 for the leveraging device 40. The first sections 68, 70 extends considerably further radially out from the respective rotation axis 42, 44 than the second sections 78, 80 providing leveraging capability.

The first stud 84 engaged slidably to the first cam lever 64 of the first leveraging device 38, projects generally inward from the first side wall 55 of the support structure 30 along a first centerline 92 disposed substantially parallel to the first rotation axis 42. The second stud 86 engaged slidably to the second cam lever 66 of the first leveraging device 38 projects inward from the opposite second side wall 57 of the support structure 30 and preferably along the same first centerline 92. Similary, the third stud 88 engaged slidably to the first cam lever 64 of the second leveraging device 40 projects inward from the second side wall 57 of the support structure 30 along a second centerline 94 disposed substantially parallel to the second rotation axis 44. The fourth stud 90 engages slidably to the second cam lever 66 of the second leveraging device 40 and projects inward from the first wall 55 of the support structure 30 and preferably along the same second centerline 94. All four studs 84, 86, 88, 90 project substantially horizontally and inward to respective pedestals 96 which project upward from the contoured bottom 48 of the support structure 30 for added strength and rigidity during the mating process.

Figure 4:
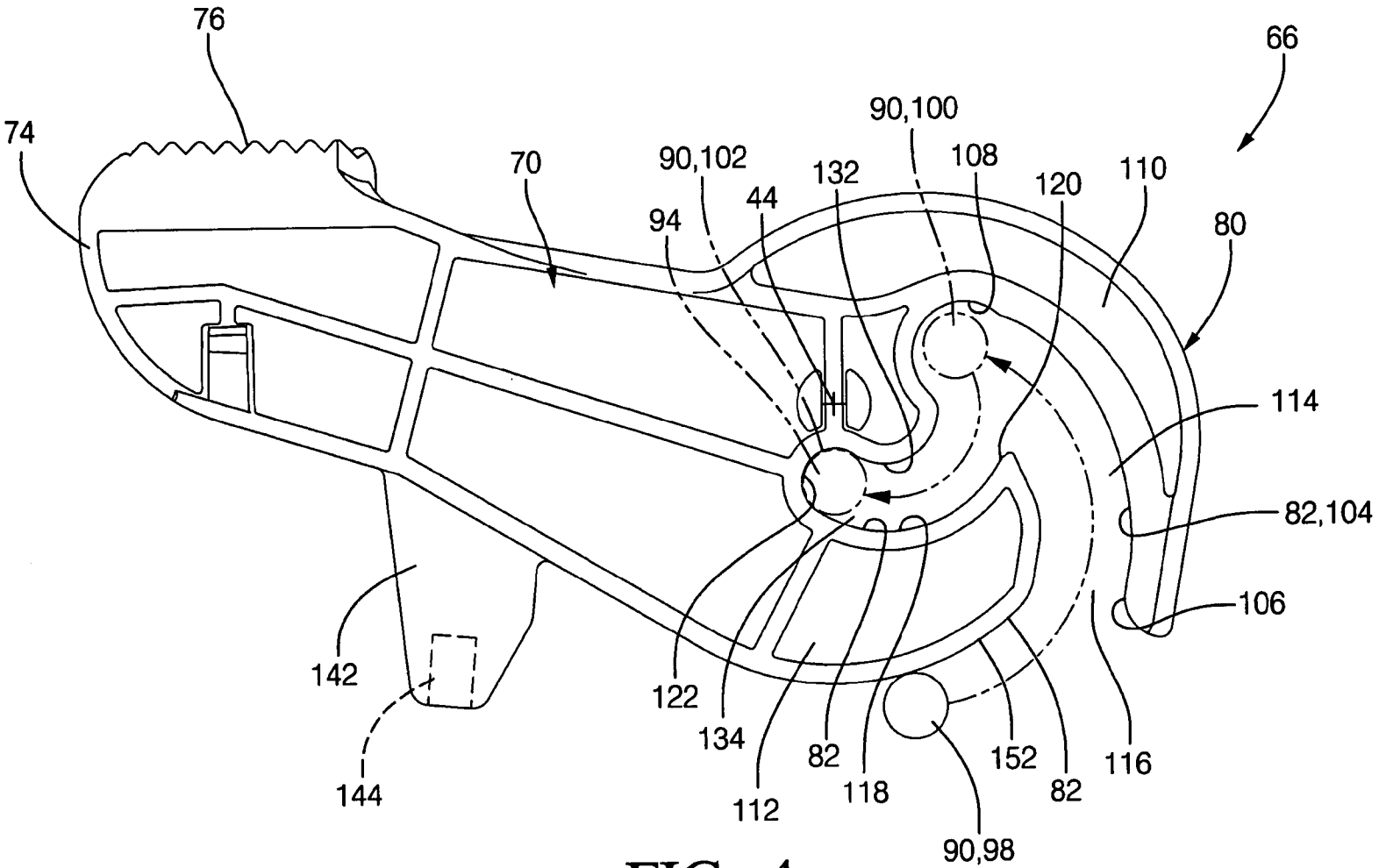
FIG. 4 is a side view of a cam lever of the electrical connector assembly.
Figure 5:
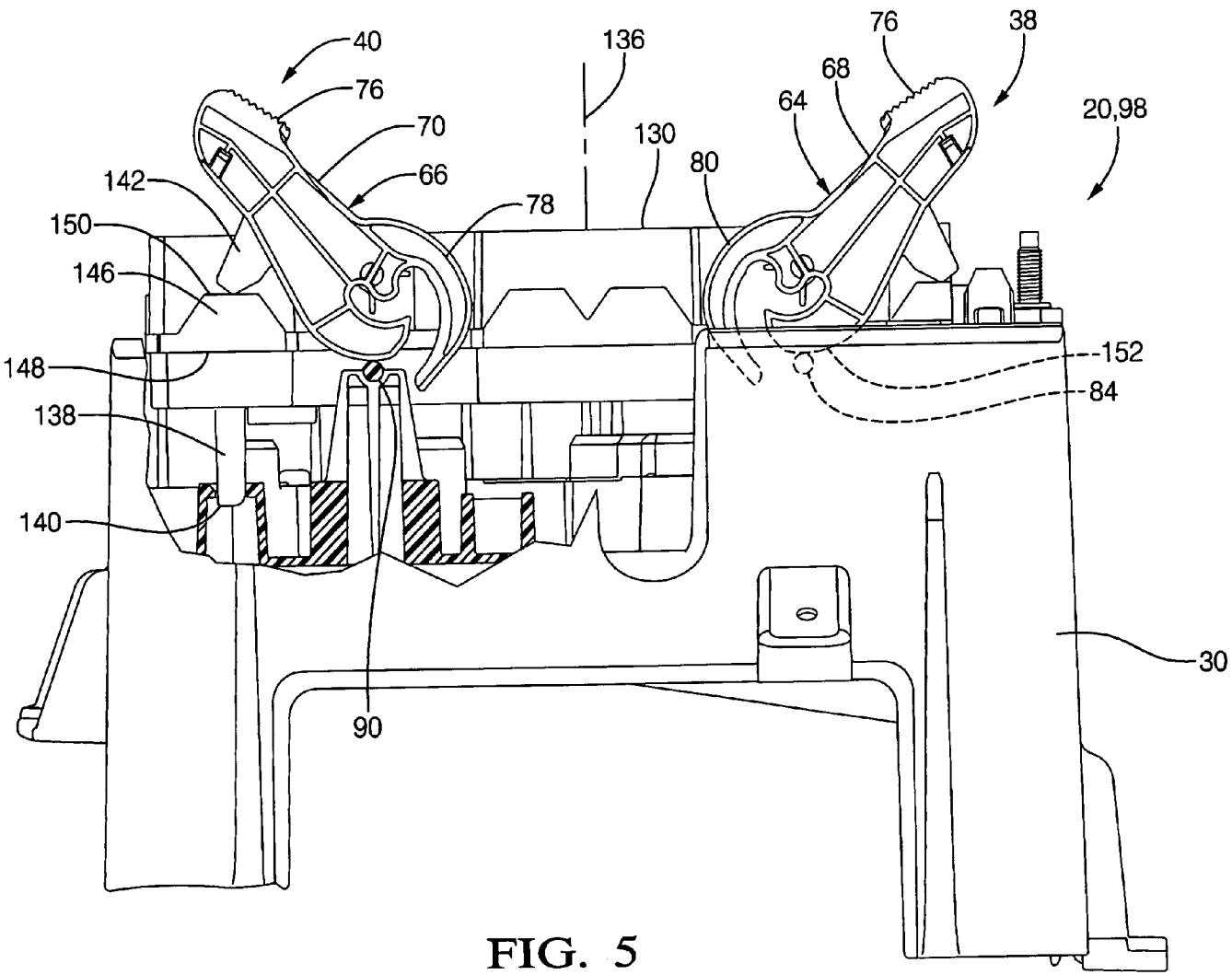
FIG. 5 is a side view of the electrical connector assembly with portions cut away to illustrate a disconnected position.
Figure 6:
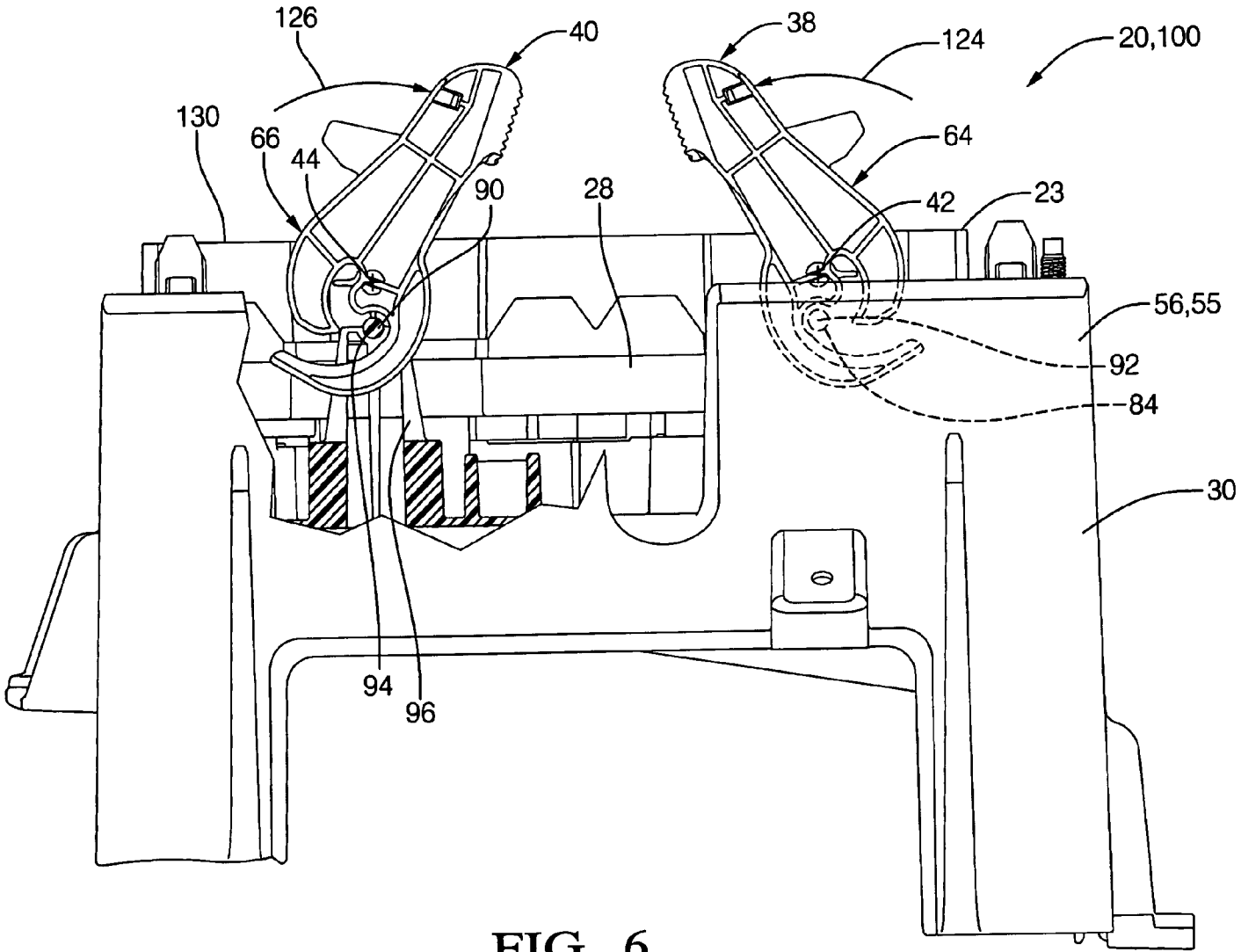
FIG. 6 is a side view of the electrical connector assembly with portions cut away to illustrate a staged position.
Figure 7:
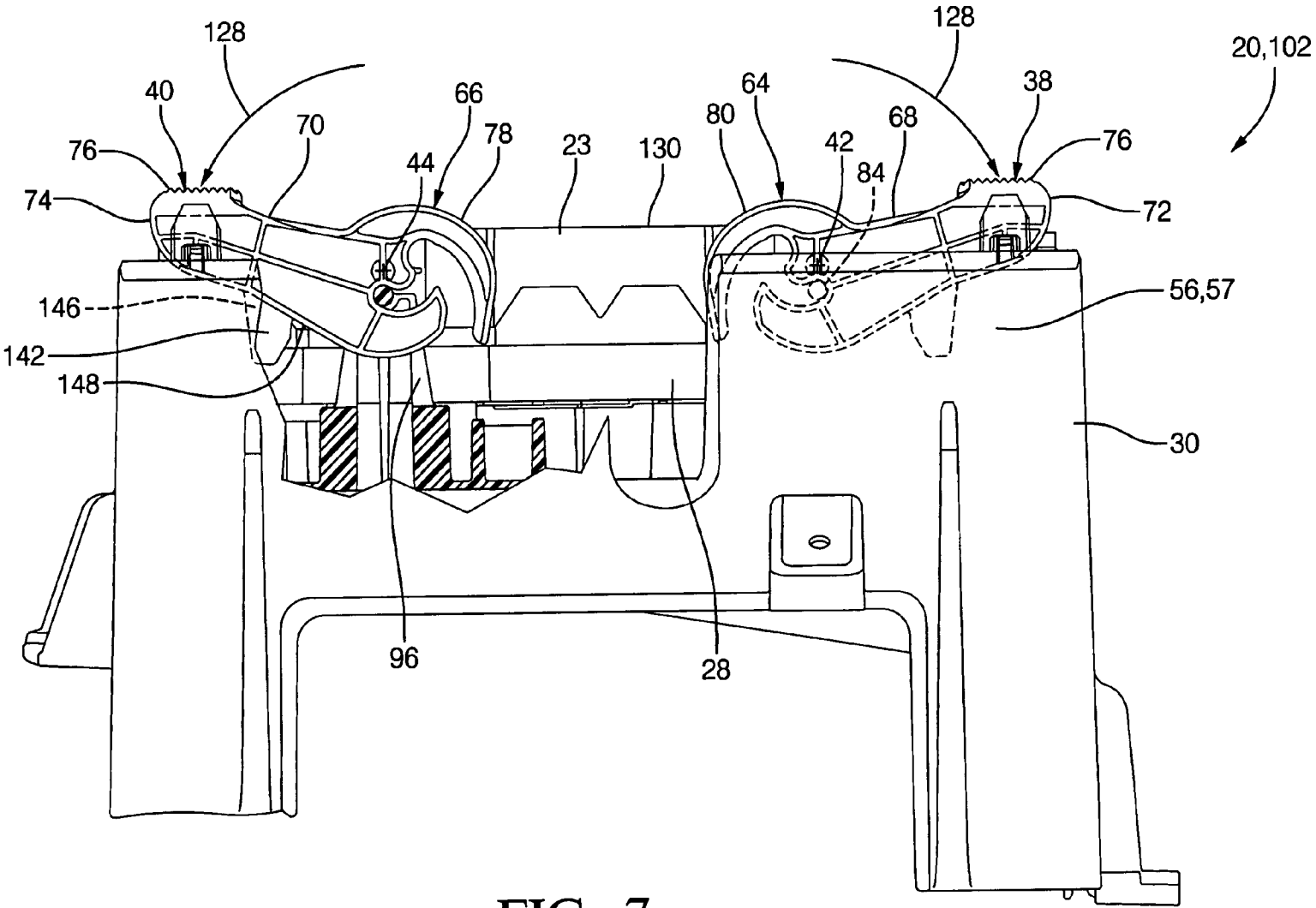
FIG. 7 is a side view of the electrical connector assembly with portions cut away to illustrate a mated position.

During the mating process, the panel 23 and mid tray 28 generally move linearly along the mating axis 36 from a disconnected position 98 (as best illustrated in FIGS. 4 and 5), to a staged position 100 (as best illustrated in FIGS. 4 and 6), and then to a mated position 102 (as best illustrated in FIGS. 4 and 7). The positions 98, 100, 102 are generally defined or created by discontinuities of the track 82. A first portion 104 of the track 82 spirals radially inward with respect to the rotation axis 42 or 44 from a receiving or distal end 106 to a staged end 108. The first portion 104 of the track is carried by a hook segment 110 of the second section 78 or 80 and generally faces toward the rotation axis 42 or 44. A claw segment 112 of the second section 78 or 80 and the first portion 104 of the track 82 define an outer slot 114 having an opening 116 at the receiving end 106 of the track 82 for initially accepting the respective studs, 84, 86, 88, 90. In general, the claw segment 112 circumferentially curves or spirals in an opposite direction than the hook segment 110. A second portion 118 of the track 82 also spirals radially inward with respect to the rotation axis 42 or 44 but in an opposite circumferential direction than the first portion 104, and from a catch end 120 to a mated end 122. The catch end 120 is generally disconnected from the staged end 108 of the first portion 104 and is spaced from the staged end 108 by a distance greater than the diameter of the studs 84, 86, 88, 90. The catch end 120 is positioned to generally face both the rotation axis 40 or 44 and the staged end 108 of the first portion 104. The second portion 118 of the track 82 is carried by the claw segment 112 of the second section 78 or 80 and generally faces toward the rotation axis 40 or 42.

To linearly move the panel sub-assembly 22 along the mating axis 36 from the disconnected position 98 to the staged position 100, opposing leveraging devices 38, 40 are appropriately rotated to align the openings 116 of the outer slots 114 to the studs 84, 86, 88, 90. Once aligned, the first leveraging device 38 is rotated in a counter-clockwise direction (as indicated by arrow 124 in FIG. 6) and the second leveraging device 40 is rotated in a clockwise direction (as indicated by arrow 126) by an assembler grasping the respective handles 76 and moving them toward one-another simultaneously. During this initial rotation of about eighty to one hundred degrees, the studs 84, 86, 88, 90 slide along the first portions 104 of the track 82 until they abut the staged end 108 stopping the rotational motion of the leverage devices 38, 40 and indicating that the panel sub-assembly 22 is in the staged position 100.

To linearly move the panel sub-assembly 22 along the mating axis 36 from the staged position 100 to the mated position 102, the assembler moves the handles 76 in an opposite rotational direction (as indicated by arrows 128 in FIG. 7) and generally away from one-another. This rotates the respective cam lever pairs 38, 40 about the respective rotation axes 42, 44 causing the studs 84, 86, 88, 90 to lift off of the staged end 108 of the first portion 104 of the track 82 and catching the studs at the respective catch ends 120 of the second portions 118 of the track 82. The stud 84, 86, 88, 90 then slides along the second portion 118 until it abuts the mated end 122 of the second portion 118 signifying that the mated position 102 of the panel sub-assembly 22 has been reached. When in the mated position 102, the handles 76 are preferable at a maximum distance away from one-another and orientated substantially flush with a top surface or rim 130 of the panel 23. To protect the electrical components, protruding upward from the top surface, a lid 132 of the assembly 20 snap fits over the panel 23 and generally over the leveraging devices 38, 40, and preferably about the exterior walls 56 of the support structure 30.

Preferably, the second section 78, 80 of the respective cam levers 64, 66 carry a third portion 132 of the track 82 which faces substantially radially outward and generally opposes the second portion 118 (as best shown in FIG. 4). The third portion 132 extends between the mated end 122 of the second portion 118 and the staged end 108 of the first portion 104. An inner slot 134 which communicates with the outer slot 114 at the staged end 108 is generally defined by the second portion 118 and third portion 132 of the track 82. It is within the inner slot 134 that the stud 84, 86, 88, 90 moves when the assembly 20 moves along the mating axis 36 between the mated position 102 and staged position 100. When the assembler moves the handles 76 toward one another, the studs 84, 86, 88, 90 lift off of the respective mated end 122 of the second portion 118 of the track 82 and slide along the third portion 132 until the outer slot 114 is reached. At this point, the panel sub-assembly 22 can be generally lifted away from the support structure 30 and electrical connector bodies 32.

Preferably, the staged end 108 of the first portion 104 of the track 82 is a concave face which opens radially outward with respect to the respective rotation axes 42, 44. The congruent formation between the concave face 108 and the third portion 132 forms an apex 136 which points generally radially outward and prevents the stud 84, 86, 88, 90 from inadvertently sliding into the inner slot 134 when the panel sub-assembly 22 is intended to remain in the staged position 100.

Preferably, the support structure 30, electrical connector bodies 32 (except for the conductive female terminals), cam leverage devices 38, 40 and panel sub-assembly 22 (except for the male blades), are all made of an electrically insulating and corrosion resistant material such as injection molded plastic. Molded unitarily to the mid tray 28 of the panel sub-assembly 22 are four downward projecting indices or profiled shafts 138 disposed near each corner for aligning and guiding the panel sub-assembly 22 along the mating axis 36. The shafts 138 are received in correspondingly profiled wells 140 formed in the support structure 30. Because each shaft 138 is slightly longer than the mating distance when the panel sub-assembly 22 moves from the dis-connected position 98 to the mated position 102, the distal ends of each shaft 138 rest slightly within the corresponding well 140 when the assembly 20 is in the dis-connected position 98. In this way, the panel sub-assembly 22 aligns to the central mating axis 36 before the mating process begins. Once aligned, the cam leveraging devices 38, 40 are also aligned to the corresponding studs 84, 86, 88, 90. Preferably, at least one indice or shaft 138 and corresponding well 140 has a different profile than the remaining shafts and wells to prevent incorrect positioning of the panel sub-assembly 22 and to prevent possible damage during the mating process.

Referring to FIGS. 4, 5 and 7, when the assembly 20 is in the mated position 102 and the leveraging device handles 76 are substantially flush with the panel sub-assembly 22, the leveraging devices 38, 40 are snap locked to the panel 23 of the panel sub-assembly 22 by ramped flexible flaps 142 which project substantially downward to a ramped tab 144 that flexes over a radially outward projecting rib 146 of the panel 23 and snap engages to a downward facing shelf or rim 148 of the rib 146. Once locked, the leveraging devices 38, 40 can not be inadvertently rotated which would otherwise un-mate the assembly 20.

When the assembly 20 is in the dis-connected position 98, the flaps 142 rest upon an opposite upward facing shelf of the rim 150 thus elevating the handles 76 of the leveraging devices 38, 40 above the panel sub-assembly 22. When so positioned, the shafts 138 are slightly inserted into the corresponding wells 140 as previously described, and the studs 84, 86, 88, 90 rest upon a fourth portion 152 of the track 82 of the cam section 78, 80 of each cam lever 64, 66. The fourth portion 152 of the track 82 is carried radially outward by the claw segment 112 and with respect to the rotation axis 42, 44. Unlike the first and second portions 104, 118 of the track 82, the fourth portion 152 does not necessarily spiral toward the rotation axis 42, 44 of the respective levers 64, 66. Instead, the fourth track 152 extends circumferentially about the respective rotation axis 42, 44 and at a substantially equal radial distance until the fourth portion 152 reaches the opening 116 of the outer slot 114. The fourth portion 152 thus provides a degree of tolerance wherein the handles 76 can be rotated about respective rotation axis 42, 44 without producing any substantial movement along the mating axis 36 and until the stud 84, 86, 88, 90 falls through the opening 116 of the outer slot 114. Once the stud 84, 86, 88, 90 is through the opening 116, it falls off of the fourth portion 152 and is caught generally by the receiving end 106 of the first portion 104 at which point an assembler's continued movement of the handles 76 toward one-another will cause the panel sub-assembly 22 to begin moving in a linear mating direction and the indices or shafts 138 to move further into the wells 140 helping to guide the panel sub-assembly 22 linearly along the mating axis 36.

Referring to FIGS. 8, 8*a* and 10, the electrical connector bodies 32 are generally snap locked to the support structure 30 in the cavities 46 defined by the contoured bottom 48 and peripheral walls 50, by a series of flex arms 154 projecting upward from the peripheral walls 50. A ramped head or catch 156 located at the distal end of each flex arm 154 is routed through a loop member 158 projecting outward from the sides of the connector bodies 32. When the body 32 is completely inserted into the respective cavity 46, the catch 156 clears the loop member 158 and the arm 154 resiliently flexes back to it's natural state moving the catches laterally outward with respect to the body 32 and thus catching the loop member 158 for a locking fit. When locked, the bodies 32 are elevated or spaced away from the contoured bottom 48 by a shelf or platform 160 of the peripheral wall 50 and enough to permit routing of the wire harness 34 upward into the connector body 32.

Figure 11:
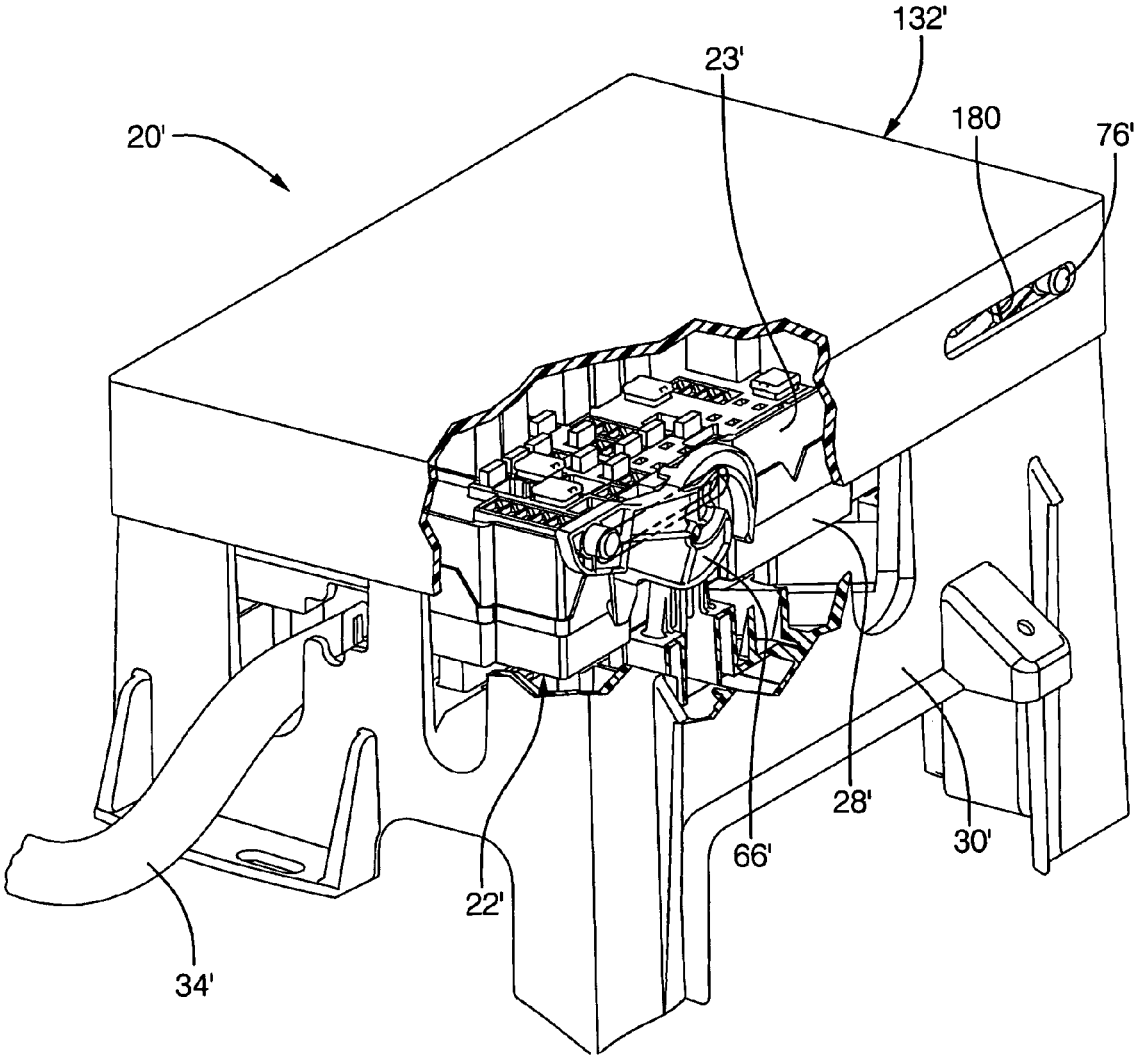
FIG. 11 is a perspective view of a second embodiment of an electrical connector assembly with portions removed to show internal detail.

Referring to FIG. 11, a second embodiment of the present invention is illustrated having like identifying numerals depicting similar elements. An electrical connector assembly 20' of the second embodiment generally replaces the two handles 76 of the first embodiment with four bosses 76' that project laterally outward and are received slideably into four substantially horizontal slots 180 in the cover 132'. In this embodiment, vertical movement of the cover 132' causes the cam levers 64', 66' to rotate, as previously described, and as the bosses 76' slide in the slots 180.

While the forms of the invention herein disclosed constitute a presently preferred embodiment, many others are possible. It is not intended herein to mention all the possible equivalent forms or ramifications of the invention. It is understood that the terms used herein are merely descriptive rather than limiting and that various changes may be made without departing from the spirit or scope of the invention.

We claim:

1. An electrical connector assembly comprising:

an electrically insulating connector body;

an electrically conductive first terminal engaged rigidly to the connector body;

an electrically insulating panel sub-assembly constructed and arranged to mate with the electrical connector body along a mating axis;

an electrically conductive second terminal engaged rigidly to the panel sub-assembly and constructed and arranged to mate with the first terminal along the mating axis;

a first cam stud engaged to the electrical connector body;

a second cam stud engaged to the electrical connector body;

a first cam lever attached rotatably to the panel sub-assembly about a first rotation axis disposed orthogonally to the mating axis, wherein the first cam lever is in sliding contact with the first cam stud and rotates clockwise to move the panel sub-assembly linearly along the mating axis toward the electrical connector body; and a second cam lever attached rotatably to the panel sub-assembly about a second rotation axis disposed orthogonally to the mating axis and parallel to the first rotation axis, wherein the second cam lever is in sliding contact with the second cam stud and rotates counter-clockwise to move the panel sub-assembly linearly along the mating axis toward the electrical connector body and to counter a moment created by the generally simultaneous rotation of the first cam lever;

the first cam lever having a cam track for sliding contact with the first cam stud;

the cam track having:

a first portion extending gradually radially inward toward the first rotation axis from a receiving end for initial contact of the cam stud to a staging end; and a second portion being in disconnected relationship to the first portion and extending gradually radially inward toward the first rotation axis from a catch end to a mated end;

wherein the first portion spirals radially inward toward the first rotation axis generally in a first circumferential direction and the second portion spirals radially inward toward the rotation axis generally in an opposite circumferential direction.

2. The electrical connector assembly set forth in claim 1 further comprising:

a cam track carried by each of the first and second levers for sliding contact with the respective first and second cam studs; and wherein the cam tracks generally spiral toward the respective first and second rotation axes.

3. The electrical connector assembly set forth in claim 1 wherein the first rotation axis is spaced laterally away from the second rotation axis.

4. The electrical connector assembly set forth in claim 3 further comprising an imaginary plane disposed orthogonally to the central mating axis and containing the first and second rotation axes.

5. The electrical connector assembly set forth in claim 1 further comprising:

an arm of each of the first and second cam levers projecting radially outward with respect to the respective first and second rotation axes; and a flexible flap projecting tangentially outward from each of the arms with respect to the respective first and second rotation axes, the flap being snap locked to the panel sub-assembly when the electrical connector assembly is mated.

6. The electrical connector assembly set forth in claim 5 further comprising:

an exterior shelf carried by the panel sub-assembly and facing axially toward the electrical connector body with respect to the mating axis; and a ramped tab carried by the respective flaps and snap locked to the exterior shelf when the electrical connector assembly is mated.

7. The electrical connector assembly set forth in claim 1 further comprising:

a first and an opposite second side wall of the panel sub-assembly disposed substantially orthogonally to the first and second rotation axes;

a third cam stud engaged to the electrical connector body and aligned to the first cam stud along a first centerline disposed substantially parallel to the first rotation axis;

a fourth cam stud engaged to the electrical connector and aligned to the second cam stud along a second centerline disposed substantially parallel to the second rotation axis;

a first leveraging device engaged rotatably to the panel sub-assembly and about the first rotation axis, the first leveraging device having the first cam lever and a third cam lever; and a second leveraging device engaged rotatably to the panel sub-assembly and about the second rotation axis, the second leveraging device having the second cam lever and a fourth cam lever.

8. The electrical connector assembly set forth in claim 7 further comprising:

first and third arms of the respective first and third cam levers projecting radially outward with respect to the first rotation axis;

second and fourth arms of the respective second and fourth cam levers projecting radially outward with respect to the second rotation axis;

a first handle of the first leverage device extending between the first and third arms; and a second handle of the second leverage device extending between the second and fourth arms.

9. The electrical connector assembly set forth in claim 8 wherein the first handle is parallel to the first rotation axis and the second handle is parallel to the second rotation axis.

10. An electrical connector assembly comprising:

an electrically insulating connector body;

an electrically conductive first terminal engaged rigidly to the connector body;

an electrically insulating panel sub-assembly constructed and arranged to mate with the electrical connector body along a mating axis;

an electrically conductive second terminal engaged rigidly to the panel sub-assembly and constructed and arranged to mate with the first terminal along the mating axis;

a first cam stud engaged to the electrical connector body;

a second cam stud engaged to the electrical connector body;

a first cam lever attached rotatably to the panel sub-assembly about a first rotation axis disposed orthogonally to the mating axis, wherein the first cam lever is in sliding contact with the first cam stud and rotates clockwise to move the panel sub-assembly linearly along the mating axis toward the electrical connector body;

a second cam lever attached rotatably to the panel sub-assembly about a second rotation axis disposed orthogonally to the mating axis and parallel to the first rotation axis, wherein the second cam lever is in sliding contact with the second cam stud and rotates counter-clockwise to move the panel sub-assembly linearly along the mating axis toward the electrical connector body and to counter a moment created by the generally simultaneous rotation of the first cam lever; and a cam track carried by each of the first and second levers for sliding contact with the respective first and second cam studs;

wherein the cam tracks generally spiral toward the respective first and second rotation axes;

wherein the first and second studs each have a diameter and a centerline disposed substantially parallel to the respective first and second rotation axes;

wherein a first portion of the cam tracks generally face the respective first and second rotation axes and have a radially outward receiving end for initial receipt of the respective first and second studs and an opposite, radially inward, staging end;

wherein a second portion of the cam tracks are in disconnected relationship to the first portion and generally face the respective first and second rotation axes, the second portion having a radially outward catch end and an opposite, radially inward, mated end; and wherein the catch end generally faces the rotational center and faces the staging end, and is spaced from the staging end by a distance which is greater than the diameter of the respective first and second studs.

11. The electrical connector assembly set forth in claim 10 wherein the first and second cam studs are disposed at the respective receiving ends when the panel sub-assembly is in a disconnected position, and wherein clockwise rotation of the first cam lever and counter clockwise rotation of the second cam lever causes the panel sub-assembly to move linearly along the mating axis from the disconnected position and to a staged position as the first and second studs slide along the respective first portions from the receiving end to the staging end.

12. The electrical connector assembly set forth in claim 11 wherein the counter-clockwise rotation of the first cam lever and clockwise rotation of the second cam lever when the panel subassembly is initially in the staged position causes the panel sub-assembly to move linearly along the mating axis to a mated position as the first and second studs lift off the staging end, contact the catch end and slide along the second portion to the mated end.

13. An electrical connector assembly comprising:

an electrical connector body;

an electrical panel sub-assembly matable with the electrical connector body along a mating axis, the electrical panel sub-assembly having a rotation axis disposed orthogonally to the mating axis;

a cam stud engaged to the electrical connector body and extending along a centerline disposed parallel to the rotation axis, the cam stud having a diameter; and a cam lever attached rotatably to the electrical panel sub-assembly about the rotation axis, the cam lever having a cam track for sliding contact with the cam stud;

the cam track having:

a first portion extending gradually radially inward toward the rotation axis from a receiving end for initial contact of the cam stud, and to a staging end;

a second portion being in disconnected relationship to the first portion and extending gradually radially inward toward the rotation axis from a catch end to a mated end;

a third portion of the cam track extending gradually radially outward from the mated end and toward the staged end; and an inner blind slot communicating through the cam lever and defined laterally between the second and third portions;

wherein the catch end generally faces the rotation axis and faces the staging end, and is spaced from the staging end by a distance which is greater than file stud diameter.

14. The electrical connector assembly set forth in claim 13 further comprising:

the cam stud being disposed at the receiving end when the electrical panel sub-assembly is in a disconnected position, and wherein clockwise rotation of the cam lever causes the electrical panel sub-assembly to move along the mating axis from the disconnected position and to a staged position as the cam stud slides along the first portion from the receiving end to the staging end;

wherein counter-clockwise rotation of the cam lever when the electrical panel sub-assembly is initially in the staged position causes the electrical panel sub-assembly to move along the mating axis to a mated position as the cam stud lifts off the staging end, contacts the catch end and slides along the second portion to the mated end; and wherein clockwise rotation of the cam lever when the electrical panel sub-assembly is initially in the mated position causes the electrical panel sub-assembly to move along the mating axis to the staged position as the cam stud slides along the third portion to the staged end of the first portion.

15. The electrical connector assembly set forth in claim 13 further comprising a concave face at the staged end of the first portion which faces radially outward with respect to the rotation axis for removably seating the cam stud.

16. The electrical connector assembly set forth in claim 15 further comprising:

a second stud engaged to the electrical connector body and orientated along a second centerline spaced laterally from and parallel to the centerline;

a second rotation axis spaced laterally from and parallel to the rotation axis;

a second cam lever engaged rotatably to the electrical panel sub-assembly at the second rotation axis; and wherein the second cam lever rotates opposite to the cam lever.

17. The electrical connector assembly set forth in claim 13 wherein the cam stud is disposed at the receiving end when the shroud is in a disconnected position, and wherein clockwise rotation of the cam lever causes the electrical panel to move along the mating axis from the disconnected position and to a staged position as the cam stud slides along the first portion from the receiving end to the staging end.

18. The electrical connector assembly set forth in claim 17 wherein the counter-clockwise rotation of the cam lever when the electrical panel sub-assembly is initially in the staged position causes the electrical panel sub-assembly to move along the mating axis to a mated position as the cam stud lifts off the staging end, contacts the catch end and slides along the second portion to the mated end.

19. The electrical connector assembly set forth in claim 18 wherein the first and second portions of the cam track extend radially inward in a spiral fashion.

20. The electrical connector assembly set forth in claim 19 further comprising a concave face at the staged end of the first portion which faces radially outward with respect to the rotation axis for seating the cam stud when the electrical connector assembly is in the staged position, and forms congruently into the third portion at an apex.

21. An electrical connector assembly comprising:

an electrical connector body;

an electrical panel sub-assembly matable with the electrical connector body along a mating axis, the electrical panel sub-assembly having a rotation axis disposed orthogonally to the mating axis;

a cam stud engaged to the electrical connector body and extending along a centerline disposed parallel to the rotation axis, the cam stud having a diameter; and a cam lever attached rotatably to the electrical panel sub-assembly about the rotation axis, the cam lever having a cam track for sliding contact with the cam stud;

the cam track having:

a first portion extending gradually radially inward toward the rotation axis from a receiving end for initial contact of the cam stud, and to a staging end; and a second portion being in disconnected relationship to the first portion and extending gradually radially inward toward the rotation axis from a catch end to a mated end;

wherein the catch end generally faces the rotation axis and faces the staging end, and is spaced from the stage end by a distance which is greater than the stud diameter; and wherein the first portion spirals radially inward toward the rotation axis generally in a first circumferential direction and the second portion spirals radially inward toward the rotation axis generally in an opposite circumferential direction.

22. A method for mating an electrical connector assembly comprising the steps of:

placing an electrical panel sub-assembly over an electrical connector body;

aligning a first cam stud to a disconnect end of a first portion of a track of a first cam lever engaged rotatably to the electrical panel sub-assembly;

rotating the first cam lever in a clockwise direction about a first rotation axis causing the first cam stud to slide along the first portion as the electrical panel sub-assembly moves in a linear direction toward the electrical connector body;

abutting the first cam stud to a staged end of the first portion placing the electrical panel sub-assembly in a staged position;

rotating the first cam lever in a counter-clockwise direction about the first rotation axis causing the first cam stud to lift off of the staged end and slideably engage a radially outward catch end of a second portion of the track and causing the first cam stud to slide along the second portion, the second portion being in disconnected relationship to the first portion and generally facing the first rotation axis; and abutting the first cam stud against a radially inward mated end of the second portion placing the electrical connector assembly in a mated position.

23. The method for mating an electrical connector assembly set forth in claim 22 comprising the additional steps of:

aligning a second cam stud to an initial contact end of a first portion of a track of a second cam lever engaged rotatably to the electrical panel sub-assembly;

rotating the second cam lever in a counter-clockwise direction as the first cam lever is rotated in the clockwise direction, causing the second cam stud to slide along the first portion of the second cam lever as the electrical panel sub-assembly moves in the linear direction toward the electrical connector body;

abutting the second cam stud to a staged end of the first portion of the second cam lever placing the electrical panel sub-assembly in the staged position;

rotating the second cam lever in a clockwise direction as the first cam lever is rotated in the counter-clockwise direction causing the second cam stud to lift off of the staged end of the second cam lever and slideably engage a catch end of a second portion of the track of the second cam lever and causing the second cam to slide along the second portion of the second cam lever; and abutting the second cam stud against a mated end of the second portion of the second cam lever placing the electrical connector assembly in the mated position.

24. The method for mating the electrical connector assembly set forth in claim 22 compirsing the additional step of unmating the electrical connector assembly by rotating the first cam lever in a clockwise direction causing the first cam stud to lift off of the mated end of the second portion and slide along a third portion of the track which extends gradually radially outward to the staged end of the first portion, and stopping the rotation when the first cam stud reaches the staged end thus placing the electrical panel sub-assembly back into the staged position.

* * * * *